US005448066A

United States Patent [19]

Smith et al.

[11] Patent Number: 5,448,066

[45] Date of Patent: Sep. 5, 1995

[54] LUBRICATION SYSTEM FOR THERMALLY-IMAGED FILMS

[76] Inventors: Dana S. Smith, 25661 White Sands St., Dana Point, Calif. 92629; Howard W. Siu, 7440 E. Young Ave., South San Gabriel, Calif. 91770

[21] Appl. No.: 267,699

[22] Filed: Jun. 29, 1994

[51] Int. Cl.[6] ..... G03G 5/16

[52] U.S. Cl. ..... 250/316.1; 250/318

[58] Field of Search ..... 250/316.1, 317.1, 318; 342/171; 400/118.2, 120.1

[56] References Cited

U.S. PATENT DOCUMENTS 4,379,835 4/1983 Lowrey et al. ..... 250/317.1

4,829,050 5/1989 Henzel et al. ..... 503/227

*Primary Examiner*—Jack I. Berman

*Assistant Examiner*—Kiet T. Nguyen

*Attorney, Agent, or Firm*—Frederic P. Smith; William F. Porter, Jr.

[57] ABSTRACT

A lubrication system for thermally-imaged films comprising a thermally-active imaging film including a thermally-active imaging layer, a lubrication layer including poly(tetra-fluoroethylene) particulates coupled to said thermally-active imaging layer, and a temperature control for controlling the temperature of the lubrication layer to prevent distortion. In a particular embodiment, the lubrication layer comprises a polymeric binder having about three percent poly(tetra-fluoroethylene) particulates therein and the imaging layer includes a polymer matrix having a heat activated image producing compound therein. The temperature control prevents a heat buildup in the lubrication layer in excess of 230 millijoules per pixel. The temperature control controls the thermal output of a thermal printing head for heating selected portions of the imaging film, the lubrication layer being positioned between the printing head and the imaging layer, and includes a variable heat sink coupled to the printing head for controlling the heat transfer rate from the printing head to the lubrication layer.

20 Claims, 1 Drawing Sheet

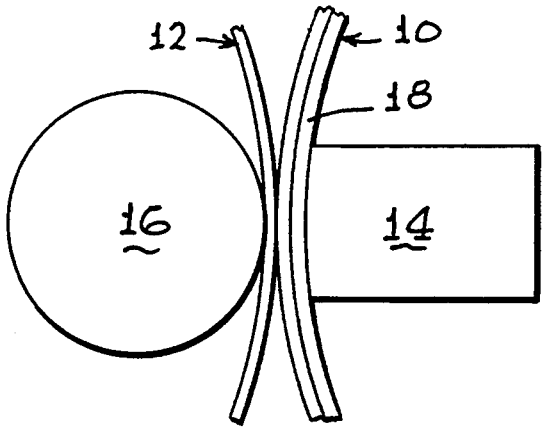
FIG. 1
PRIOR ART
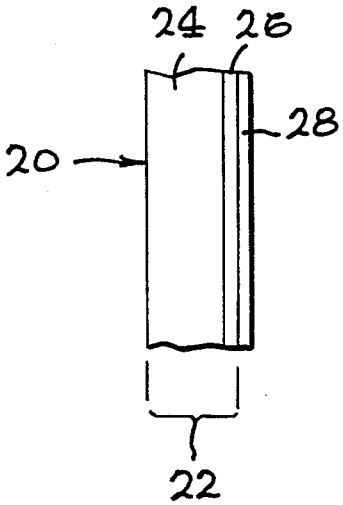
FIG. 2
FIG. 3
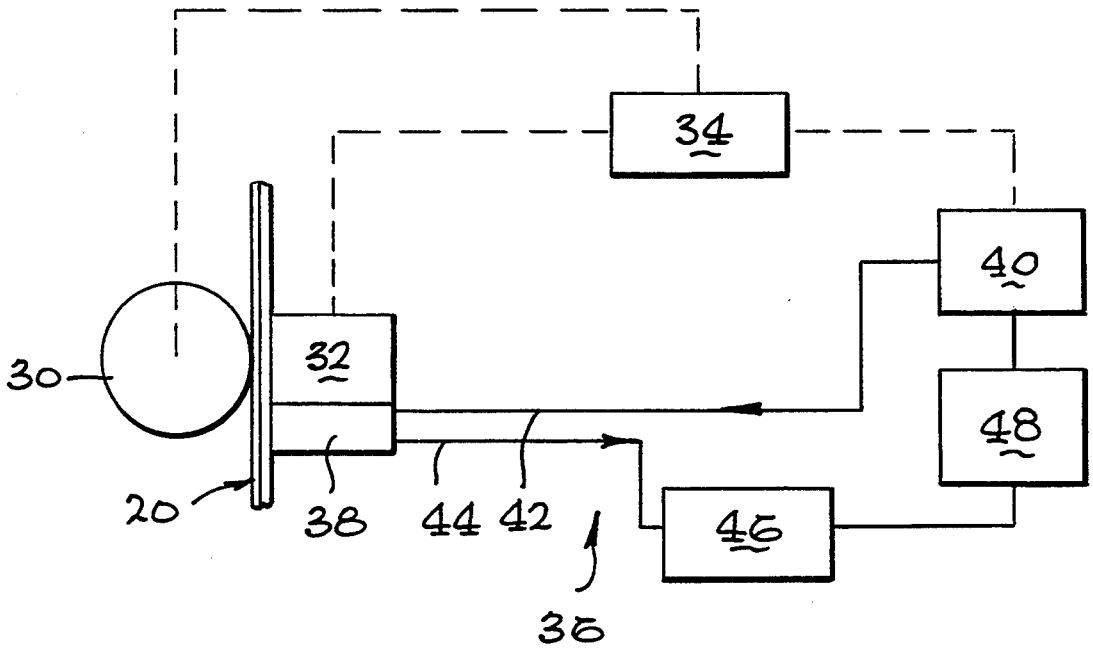

LUBRICATION SYSTEM FOR THERMALLY-IMAGED FILMS

BACKGROUND OF THE INVENTION

1. Field of the Invention

This invention relates to the field of thermally-imaged films and, in particular, to a lubrication system for thermally-imaged films which improves motion uniformity during imaging to prevent distortion.

1. Description of Related Art

With the increased use of computer hardware and software to generate information in visible multidimensional form such as graphs and graphics, as contrasted to mere numerical listings, there has come a concomitant increased use of plotters to fix such information on a tangible media. Plotters capable of handling the output of such computer systems have been developed and are continually being upgraded to ensure that fast and accurate plots are being produced. Problems have arisen, however, with plotters using thermally-imaged film in which a thermal printing head selectively heats a thermally-active imaging layer on a polyester base, the film generally being four mils thick, thirty-six inches wide and two-hundred feet long, and being transported across the printing head at a continuous rate of about 0.25"/second. Due, however, to the heat produced by the printing head, as much as 500 watts while printing a solid black area to obtain high density, the imaging layer often sticks to the head resulting in non-linear advancement in the transport mechanism and thus perceptible banding and mispositioning of the printed image pixels. In addition, the acoustic noise levels generated by the printing process are greatly increased due to a loud chattering sound caused by the jerky motion from such sticking. In order to overcome this slip-stick motion, it has been proposed to coat the imaging layer with a lubrication layer. Such layers have been used previously in thermal dye transfer processes to coat the back side of the dye donor element so that it will not stick to the thermal printing head. Such a lubrication layer is described in U.S. Pat. No. 4,829,050, entitled "Solid Particle Lubricants for Slipping Layer of Dye-Donor Element Used in Thermal Dye Transfer". While this application of the lubrication film may have been suitable for its intended usage, i.e., on the back side of a dye donor element, it has been proven to be inadequate on the top side of a thermally-active imaging layer due to the lack of control of the amount of heat being transfered to the lubrication layer by the thermal printing head. Such a lack of control not only resulted in all the problems stated in the referenced patent but also introduced an optical distortion not only in the thermally softened imaging layer but also in the lubrication layer. Since the referenced patent was concerned only with the slipping and non-sticking at the moment of transfer, it did not address the issue of the quality and integity of the lubrication layer after the moment of passage from contact with the thermal printing head.

Thus, it is a primary object of the present invention to provide an improved lubrication system for thermally-imaged films.

It is another object of the present invention to provide an improved lubrication system for thermally-imaged films which provides for linear advancement in the transport mechanism and proper positioning of written image pixels.

It is a further object of the present invention to provide an improved lubrication system for thermally-imaged films which reduces acoustic noise generated by the printing process.

It is still another object of the present invention to provide an improved lubrication system for thermally-imaged films which does not result in optical distortion in the imaging layer and in the lubrication layer.

It is a still further object of the present invention to provide an improved lubrication system for thermally-imaged films which prevents sticking of the imaging layer of the film to a thermal printing head.

SUMMARY OF THE INVENTION

A lubrication system for thermally-imaged films is provided comprising a thermally-active imaging film including a thermally-active imaging layer, a lubrication layer including poly(tetrafluoroethylene) particulates coupled to said thermally-active imaging layer, and a temperature control for controlling the temperature of the lubrication layer to prevent distortion. In a particular embodiment, the lubrication layer comprises a polymeric binder having about three percent poly(tetrafluoroethylene) particulates therein and the imaging layer includes a polymer matrix having a heat activated image producing compound therein. The temperature control prevents a heat buildup in the lubrication layer in excess of 230 millijoules per pixel. The temperature control controls the thermal output of a thermal printing head for heating selected portions of the imaging film, the lubrication layer being positioned between the printing head and the imaging layer, and includes a variable heat sink coupled to the printing head for controlling the heat transfer rate from the printing head to the lubrication layer.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 1 is a simplified illustration of the structure of the prior art system.

FIG. 2 is a simplified illustration showing the elements of the thermally-imaged film of the present invention.

FIG. 3 is a diagramatic illustration of the present invention incorporating the thermally-imaged film of FIG. 2.

DESCRIPTION OF THE PREFERRED EMBODIMENT

Referring now to FIG. 1, a dye-donor element 10 of the prior art system is shown placed face-to-face with a dye-receiving element 12 and inserted between a thermal printing head 14 and a platen roller 16. A slipping-(lubrication)layer 18, applied to the back side of the dye-donor element 10, is used to prevent the dye-donor element 10, typically a thin polyester film, from sticking to the thermal printing head 14 when the dye-donor element 10 softens during printing. As is evident, the prior art system does not address any problems that may occur in the heating of the slipping layer 18 since the slipping layer 18 is not involved in the final state of the dye-receiving element 12. In contrast, the thermally-imaged film 20 of the present invention, shown in FIG. 2, comprises a thermally-active imaging film 22, including a base layer 24 and a thermally-active imaging layer 26, and a lubrication layer 28. The base layer 24 is typically a polyester base 4 mils in thickness, the thermally-active imaging layer 26 is typically a polymer matrix 10μ in thickness and having a heat activated image producing formulation therein, and the lubrication layer 28 consists of a dry coating, such as, for example, sold by 3M under the brand name TFE Lube, of poly(tetrafluoroethylene) particulates, commonly known as TFE and often sold under the trademarked name Teflon, or a polymeric binder, such as, for example, the water-insoluble cellulosic binder referenced in the aforesaid patent, having three percent TFE particulates therein, and is generally 1μ in thickness. As is evident, since the lubrication layer 28 is an integral part of the thermally-imaged film 20 and the image is viewed through the lubrication layer 28, it is essential that the quality and integrity of such lubrication layer 28 be maintained.

Referring now to FIG. 3, a thermal-imaging system is illustrated in which the thermally-imaged film 20 is driven by a rotatable rubber pinch roller 30 between the pinch roller 30 and a thermal printing head 32, made by Rohm. The pinch roller 30 is controlled by controller 34 to drive the thermally-imaged film 20 at a continuous rate of approximately 0.25"/second, while the thermal printing head 32, in the shape of a elongated bar, is controlled by the controller 34 to selectively print two-dimensionally at approximately 16 pixels/mm. Coupled to the thermal printing head 32 is a thermal management system 36 including a heat sink 38 whose thermal capacity is varied by controller 34 which controls pump 40 to vary the flow of a coolant, such as propylene glycol, through lines 42,44 and heat heat sink 38 coupled to pump 40, exchanger 46 and reservoir 48. In the absence of any thermal control of the system, the temperature of the thermal printing head 32 was running up to 55° C., and the temperature at each pixel of the thermal printing head 32 was 360° C. and the temperature at the corresponding pixel at the lubrication layer 28 was 230° C., or a heat buildup of 260 millijoules per pixel (with a pixel being 2×3 mils in size and having an elliptical shape), resulting in distortion of the lubrication layer 28 and the thermally-active imaging layer 26. Upon activation of the thermal management system 36, however, the temperature of the thermal printing head 32 is limited to 35° C.–45° C., and the heat buildup in the lubrication layer 28 is now limited to 230 millijoules per pixel, a reduction of approximately ten percent, with the attendant result of the lubrication layer 28 remaining distortion free. Furthermore, to more finely control heat transfer to the lubrication layer 28, the controller 34 can vary the configuration of the input signal to each pixel in the thermal printing head 32 by applying, for example, a pulse modulated strobing signal.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

We claim:

1. A lubrication system for thermally-imaged films comprising:

a thermally-active imaging film including a thermally-active imaging layer;

a lubrication layer including poly(tetrafluoroethylene) particulates coupled to said thermally-active imaging layer; and temperature control means for controlling the temperature of said lubrication layer to prevent distortion.

2. The lubrication system of claim 1 wherein said lubrication layer comprises a dry coating of poly(tetrafluoroethylene) particulates.

3. The lubrication system of claim 1 wherein said lubrication layer comprises a polymeric binder having poly(tetrafluoroethylene) particulates therein.

4. The lubrication system of claim 1 wherein said lubrication layer has three percent poly(tetrafluoroethylene) particulates therein.

5. The lubrication system of claim 1 wherein said imaging layer includes a polymer matrix having a heat activated image producing compound therein.

6. The lubrication system of claim 1 wherein said temperature control means prevents a heat buildup in said lubrication layer in excess of 230 millijoules per pixel.

7. The lubrication system of claim 1 wherein said temperature control means controls the thermal output of a printing means for heating selected portions of said imaging film, said lubrication layer being positioned between said printing means and said imaging layer.

8. The lubrication system of claim 7 wherein said temperature control means includes means coupled to said printing means for controlling the heat transfer rate from said printing means to said lubricating layer.

9. The lubrication system of claim 1 wherein said temperature control means includes means for controlling the configuration of an input signal applied to a printing means for heating selected portions of said imaging film.

10. The lubrication system of claim 1 wherein said temperature control means reduces the heat buildup in said lubrication layer caused by a printing means for heating selected portions of said imaging film by at least ten percent.

11. A thermal-imaging system comprising:

a thermally-active imaging film including a thermally-active imaging layer and a lubrication layer coupled to said imaging layer, said lubrication layer containing poly(tetrafluoroethylene) particulates therein;

support means for supporting said imaging film;

printing means for heating selected portions of said imaging film, said lubrication layer being positioned between said printing means and said imaging layer; and temperature control means for controlling the temperature of said lubrication layer to prevent distortion.

12. The thermal-imaging system of claim 11 wherein said lubrication layer comprises a dry coating of poly(-tetrafluoroethylene) particulates.

13. The thermal-imaging system of claim 11 wherein said lubrication layer comprises a polymeric binder having poly(tetrafluoroethylene) particulates therein.

14. The thermal-imaging system of claim 11 wherein said lubrication layer has three percent poly(tetrafluoroethylene) particulates therein.

15. The thermal-imaging system of claim 11 wherein said imaging layer includes a polymer matrix having a heat activated image producing compound therein.

16. The thermal-imaging system of claim 11 wherein said temperature control means prevents a heat buildup in said lubrication layer in excess of 230 millijoules per pixel.

17. The thermal-imaging system of claim 11 wherein said temperature control means controls the thermal output of said printing means for heating selected portions of said imaging film, said lubrication layer being positioned between said printing means and said imaging layer.

18. The thermal-imaging system of claim 17 wherein said temperature control means includes means coupled to said printing means for controlling the heat transfer rate of said printing means, whereby said printing means has a selected heat transfer rate for transfering heat to said lubricating layer.

19. The lubrication system of claim 11 wherein said temperature control means includes means for controlling the configuration of an input signal applied to said printing means.

20. The thermal-imaging system of claim 11 wherein said temperature control means reduces the heat buildup in said lubrication layer caused by said printing means by at least ten percent.

* * * * *